US007040062B2

(12) United States Patent
Emek

(10) Patent No.: US 7,040,062 B2
(45) Date of Patent: May 9, 2006

(54) DISMANTABLE PROTECTIVE WINDOW

(75) Inventor: Mordechay Emek, Kfar Shmaryahu (IL)

(73) Assignee: Arpal Aluminum Ltd., Holon (IL)

( * ) Notice: Subject to any disclaimer, the term of this patent is extended or adjusted under 35 U.S.C. 154(b) by 580 days.

(21) Appl. No.: 09/874,965

(22) Filed: Jun. 7, 2001

(65) Prior Publication Data

US 2002/0184839 A1 Dec. 12, 2002

(51) Int. Cl.
*E06B 1/36* (2006.01)
*E06B 1/60* (2006.01)
*E06B 1/56* (2006.01)

(52) U.S. Cl. ..... 52/204.62; 52/203; 52/204.55; 52/214; 52/204.72; 52/770

(58) Field of Classification Search ..... 52/204.62, 52/202, 203, 213, 204.69, 770, 214, DIG. 12, 52/204.72, 171.1, 204.55; 49/9, 62, 322, 49/507; 109/79, 49.5
See application file for complete search history.

(56) References Cited

U.S. PATENT DOCUMENTS 3,774,363 A * 11/1973 Kent ..... 52/400
4,248,933 A * 2/1981 Katoh ..... 428/339
4,625,659 A * 12/1986 Saelzer ..... 109/49.5
4,630,411 A * 12/1986 Salzer ..... 52/1
4,879,957 A * 11/1989 Habicht et al. ..... 109/79
5,544,457 A * 8/1996 Labrecque ..... 52/204.69
5,653,073 A * 8/1997 Palmer ..... 52/204.593
5,758,459 A * 6/1998 Koike et al. ..... 52/235
5,797,229 A * 8/1998 Alvarez et al. ..... 52/204.62
6,088,978 A * 7/2000 Satterwhite ..... 52/200
6,230,455 B1 * 5/2001 Arehart et al. ..... 52/202
6,260,251 B1 * 7/2001 Guhl ..... 29/416
6,272,812 B1 * 8/2001 Richardson ..... 52/800.1
6,455,819 B1 * 9/2002 Pohl et al. ..... 219/452.12

FOREIGN PATENT DOCUMENTS

DE 2331332 * 12/1974 ..... 52/204.593
DE 3127631 * 1/1983 ..... 52/204.62
DE 3142690 * 5/1983 ..... 52/204.62

* cited by examiner

*Primary Examiner*—Carl D. Friedman
*Assistant Examiner*—Phi Dieu Tran A
(74) *Attorney, Agent, or Firm*—Oliff & Berridge, PLC

(57) ABSTRACT

A reinforced window system for mounting within an opening in a wall, the window system comprising a frame fixable to the wall and a second frame, which is removably installable in the first frame. The first frame is provided with a plurality of fixing members distributed on the inside perimeter of the first frame. The second frame carries a reinforced window pane. The second frame is provided with a plurality of support members distributed on an outside perimeter of the second frame with possibility to face the fixing members of the first frame so as to support the second frame when the support members are in engagement with the fixing members of the first frame.

26 Claims, 6 Drawing Sheets

DISMANTABLE PROTECTIVE WINDOW

FIELD OF THE INVENTION

This present invention is in the field of protective window systems providing improved protection for individual and equipment preset within a protected space or structure. In particular, the invention is concerned with a blast resistant window system which may be easily removed, e.g. for cleaning and maintenance, and reinstalled in a foolproof manner.

One particular use of such a window system is, for example, for use in preservation buildings wherein it is desired to maintain the original windows and nevertheless provide a blast resistant window protection system. Other use of such systems is for retrofit at any desired window opening.

The term "window" as used herein in the specification and claims refers to a variety of window types, e.g. swingable, tiltable casement windows, fixed windows, curtain walls, etc.

BACKGROUND OF TIE INVENTION

It is an ever-growing trend by different authorities that old buildings and monuments be preserved so as to maintain the legacy of old ages. Such buildings are often fitted with their original window systems which at times are extremely old and in many cases are no longer suitable for use. Even more so, such window systems may be unstable and loosely fitted within the opening in the wall in a manner which may be dangerous to inhabitants or visitors within the structure. Still another problem concerned in particular with old buildings, but restricted thereto, is the weakness of the walls, which may at times be vulnerable themselves.

It is also an ever-growing requirement to provide public buildings and government institutes with blast-resistant and reinforced window systems suitable for confronting terrorist attacks and the like.

A variety of blast-resistant windows and such window systems are available. However, for most such reinforced systems it is required to remove the original window system which, as mentioned hereinabove, does not suit the present case. Furthermore, it is a requirement that such a reinforced window system may be easily removed, e.g. at times when it is not required to have a reinforced window system, or for exposing the original window, maintenance thereof, cleaning, etc.

It is an object of the present invention to provide a novel reinforced window system which, on the one hand, provides a reliable blast-resistant window system and, on the other hand, is easily fitted into an opening of a wall also in case the opening is pre-fitted with an existing window system. It is a further object of the present invention to provide such a window system which is easily removed and is mounted back into place with minimum skill required.

SUMMARY OF THE INVENTION

The present invention calls for a reinforced window system which may be fitted and mounted within an opening in a wall which may already be fitted with a window, e.g. a preservation window, without causing any damage hereto. It is an important feature of the invention that the reinforced window system be adapted for easy mounting and dismounting and that it be capable of absorbing blast energy, to prevent injury and damage from people and equipment within a space in which the window is fitted, even where it is mounted on a weak wall.

According to the present invention there is provided a reinforced window system for mounting within an opening in a wall, the window system comprising a frame fixable to the opening; said frame comprising an outside support panel and one or more fixable fixing members distributed on an inside of the frame; a reinforced window pane fixedly supported with a removable frame; said removable frame comprising a plurality of support members articulated to the support frame and adapted for engagement by the corresponding fixing members; and locking members for thereby positioning and fixing the removable frame within the frame.

The window system is fitted with a blast energy absorbing mechanism wherein the support members are formed with at least one arm which at a mounted state of the support frame, extends opposite a corresponding flange associated with the frame, i.e. integral with the frame or otherwise articulated thereto. In accordance with an embodiment of the invention, the flange is a portion of the fixing members adapted for engagement with a corresponding first arm of a support member. In accordance with a further embodiment of the invention the flange is an extension of the frame adapted for engagement with a corresponding second arm of a support member.

By one particular embodiment of the invention, the support members are bifurcated elements having a first arm and a second arm, which arms at a mounted state of the support frame, extend opposite a corresponding portion of the fixing members and an extension flange of the frame.

The arrangement is such that a shock wave striking the window pane gives rise to generation of forces acting in the plane of the window pane and orthogonally thereto, displacing the support frame in an inward, radial direction, whereby the at least one arm of the support members engage the corresponding flanges.

By one particular design of the invention, the window system is a foolproof system, whereby the fixing members and the corresponding support members of the frame and the support frame, respectively, are distributed such that they extend opposite one another only at a correct mounting of the support frame within the frame, or such that only one of the support members there are provided fixing members.

The invention further calls for a framework for a removable reinforced window system comprising a frame fixable within an opening in a wall; said frame comprising an outside support panel and a plurality of fixable fixing members distributed on an inside of the frame; a reinforced window pane fixedly supported within a removable frame; said removable frame comprising a plurality of support members articulated to the support frame and adapted for engagement by the corresponding fixing members; and locking members for positioning and fixing the removable frame within the frame.

BRIEF DESCRIPTION OF THE DRAWINGS

In order to understand the invention and to see how it may be carried out in practice, one preferred embodiment will now be described, by way of anon-limiting example only, with reference to the accompanying drawings, in which.

DETAILED DESCRIPTION OF A PARTICULAR EMBODIMENT

Figure 1:
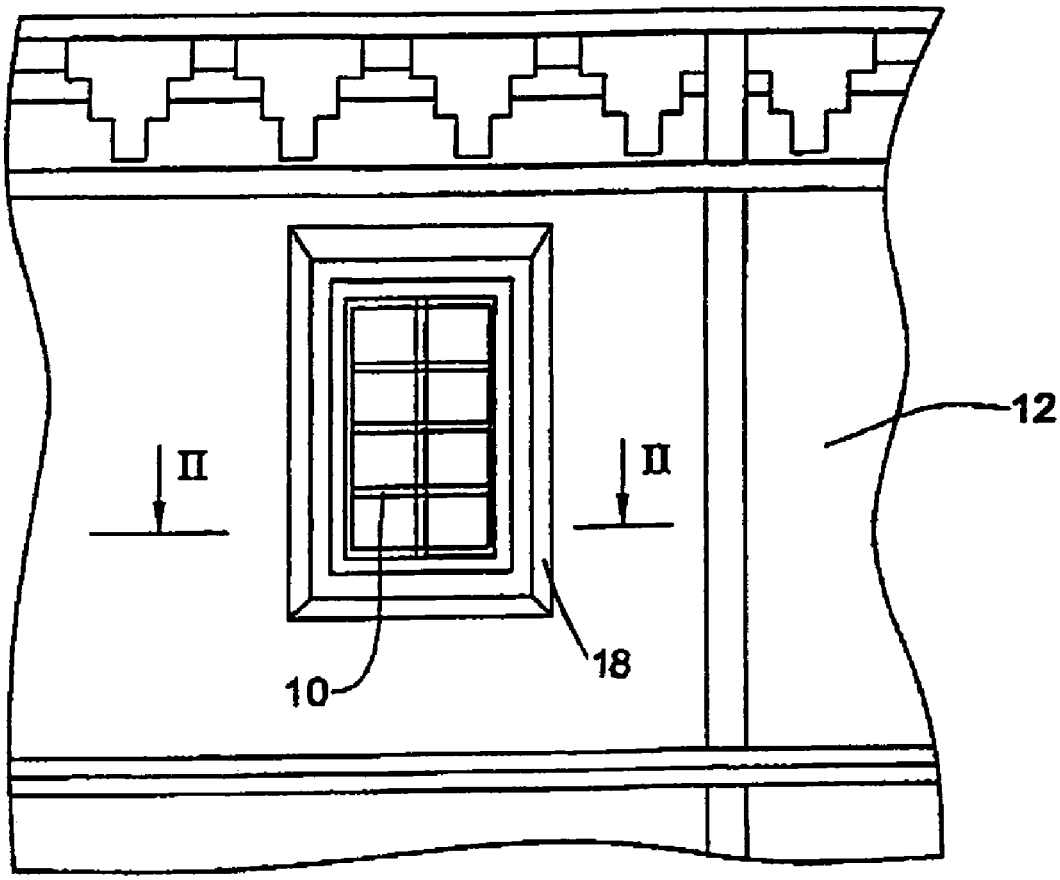
FIG. 1 is a front view illustrating a portion of a building fitted with a window system in accordance with the present invention.
Figure 2A:
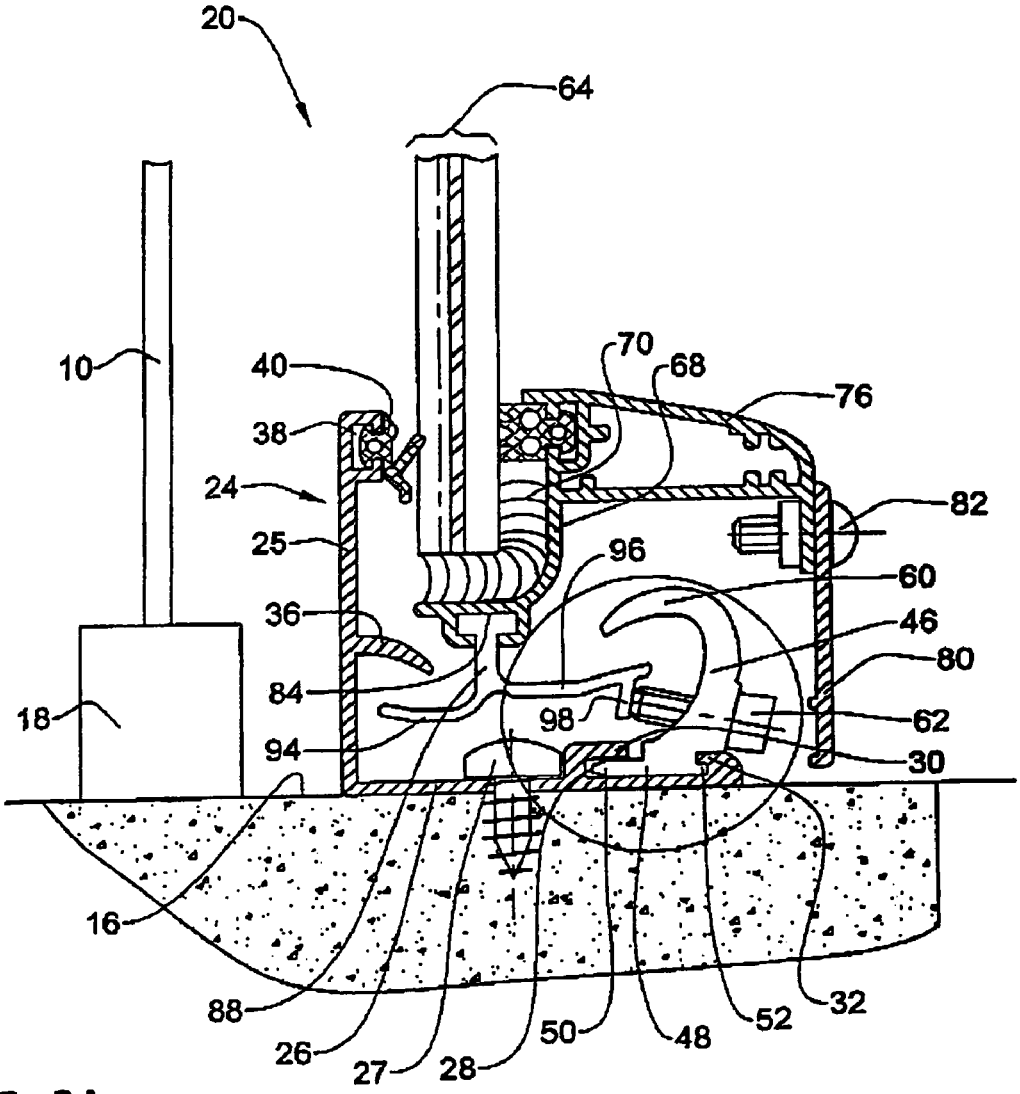
FIG. 2A is a horizontal section along line II—II in FIG. 1 through a portion of the window in accordance with the present invention.

Turning first to FIG. 1 of the drawings, there is illustrated a front view of a portion of a building, i.e. from the outside, fitted with a so-called historic window designated 10, e.g. a window which has been declared as a conservation monument, in itself, or as part of the building 12, The window 10 is schematically illustrated in FIG. 2 and is supported within an opening 16 of the wall by means of a frame 18.

When it becomes necessary to install a reinforced window system generally designated 20, a frame 24 having a general inverted L-like shape with a first arm 25 and a second arm 26, is fitted within an opening 16 by means of bolts 27. In the present embodiment, frame 24 is entirely received within opening 16 though it will be appreciated that in other cases the frame may be partially fitted within the opening 16 and partially extending into the room space or, when there is only limited space at the opening, the frame 24 may be fitted on an inside portion of the wall, corresponding with the opening 16.

As can further be seen in FIG. 2, second arm 26 of frame 24 is formed with a longitudinal receptacle recess 28 extending between two flanged portions 30 and 32, the latter being shorter than the former for a reason to become apparent hereinafter. The first arm 25 of the frame 24 is formed with an inward projecting flange 36 slightly curved. An end of the first arm 25 of frame 24 is fitted with a groove 38 supporting a resilient sealing member 40.

Figure 2B:
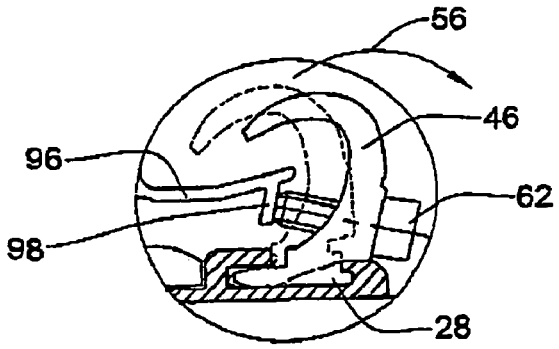
FIG. 2B illustrates the assembly of a fixing member within a frame of the window system in accordance with the present invention.

Fitted within receptacle recess 28 there is a fixing member 46 having an anchoring flange portion 48 formed with a long leg portion 50 and a short leg portion 52 and adapted for insertion into receptacle recess 28 of the frame 24 by displacing it from the initial state illustrated by dashed lines into its final position in the direction of arrow 56 (FIG. 2B). The fixing member 46 has a hook-like flange 60. A fixing member 46 may extend the entire length of each side of frame 24 or may be segments distributed therealong. Several securing bolts 62 are fitted at the fixing members distributed about the frame 24 in a manner which will securely position and fix a support frame 68 within the frame 24. It is noted that not all the fixing members 46 are fitted with securing bolts 62, and the decision how many and where to fit such securing bolts 62, depends among others on considerations of the ability to absorb blast energy, foolproof mounting (see herein later), etc. Rather then bolts 62 there may be provided locking clamps.

The frame assembly as disclosed herein so far, constitutes a portion which is fixed at the opening 16. However, the window pane is removable and may be installed ad hoc, upon demand and may easily be removed, e.g. for maintenance thereof, for reaching the historic window 10 etc.

A window pane designated 64 is in accordance with an embodiment of the invention, a reinforced window consisting of two glass panes with a layer of resin laminate therebetween. However, it is appreciated that the window pane 64 may consist of several different layers and different thickness or may be a homogenous window pane made, e.g. of polycarbonate, imparting it ballistic-resistant. The window pane 64 is fixedly attached to a support frame 68 by an adhesive, e.g. low module silicone 70, in a manner wherein the window pane 64 is attached to the support frame 68 in a secure manner which will withstand also high shear forces. The arrangement is such that the attachment of window pane 64 to support frame 68 is designed to withstand high shear forces and not to detach. The adhesive material also plays a roll in initial dampening of some of the blast energy forces. However, other mechanic arrangements may suit for that purpose, as known per Se.

Support frame 68 is integrally formed with an extension 76 which apart from imparting the support frame 68 a higher moment of inertia, it also serves for aesthetic reasons, whereby it conceals the engagement arrangement of the support frame 68 with the frame 24. A concealing frame panel 80 is removably connected to extension 76 by bolts 82 (or by a suitable locking clamp) and may have different shapes to correspond with the shape and size of the opening in the wall.

Support frame 68 further comprises a receiving groove 84 fitted for receiving with a plurality of support members 88.

Figure 3:
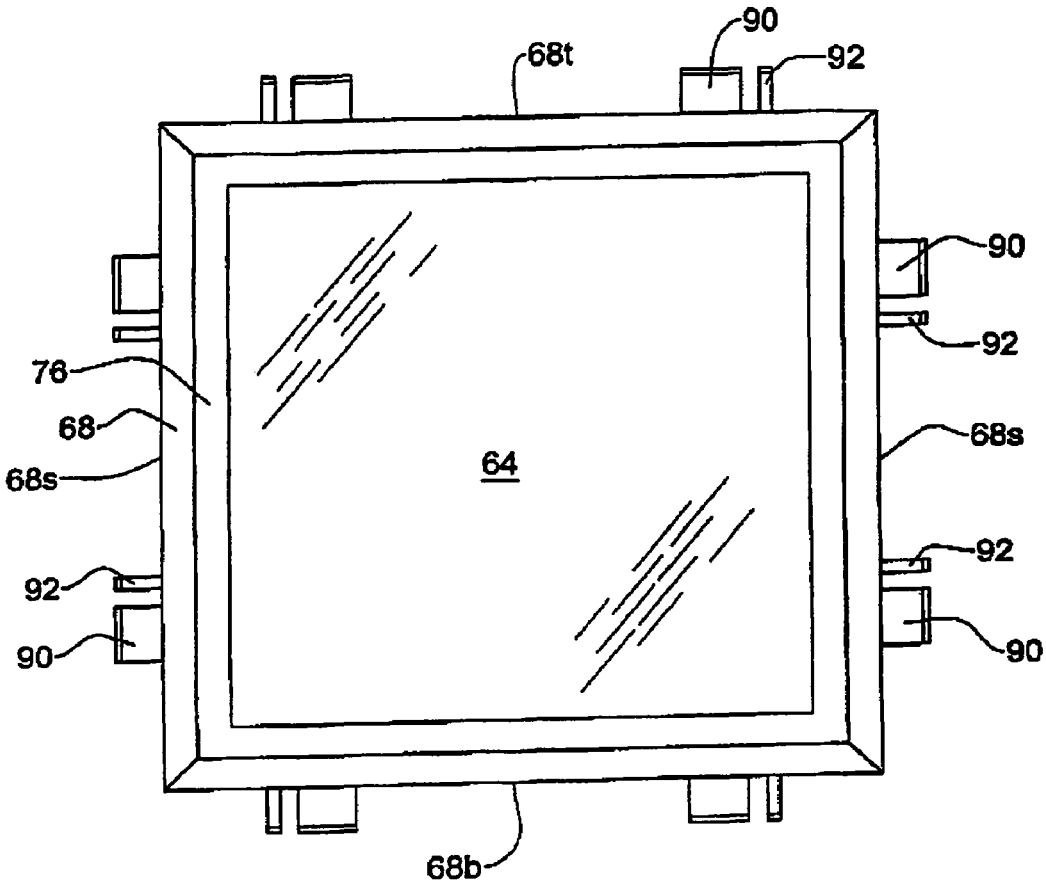
FIG. 3 is a schematic front view of a support frame according to the present invention.

Turning now to a particular embodiment depicted in FIG. 3, there is illustrated window pane 64 fitted within the support frame 68 where it is noticeable that support members are distributed along edges of the frame in pairs. Each pair consists of a wide support member 90 and a narrow support member 92, all having the same cross-section as support member 88 in FIG. 2. The support members are slidingly received within the groove 84 of support frame 68 and are fixed in place by various means as known per se, e.g. riveting, fixing bolts, etc.

The arrangement is such that the side frame members designated 68*s* are fitted with the larger support members 90 adjacent edges of the profiles 68 whilst the top and bottom support frames 68*t* and 68*b* are fitted with the narrow support members 92 adjacent the edges. This arrangement is adapted for an easy mounting of the support frame 68 within the frame 24 in a foolproof manner, whereby opposite one of the fixing members (each of the narrow fixing members 92, in the present example), there extends a securing bolt 62 of a fixing member 46. It is apparent that a myriad of positioning arrangements of the support members and the corresponding fixing members, as well as the distribution of the securing bolts, is possible. For example, support members 90 and 92 at one edge of the window, may be a unitary article. Further distinguishing may be accomplished by different color or other indications.

Reverting now to FIG. 2, it is noticeable that the support member 88 is a bifurcated member having a first arm 94 and an opposed, longer arm 96 provided with an extension 98. In the assembled position of the window system, as in FIG. 2, first arm 94 extends opposite flange 36 of frame 24 and the second arm 96 extends opposite the hook-like flange 60 of the fixing member 46. Extension 98 is engageable by securing bolt 62 in a manner which fixes the support frame 68 and secures it in its place bearing against resilient sealing member 40.

Thus, it appears that mounting and removing of the frame 68 with the window pane 64 is a simple procedure, whereby it is merely required to release bolts 62 and remove the fixing members 46, whereby the support frame 68 may be removed. Assembly is obtained in a reverse sequence of operation.

A person versed in the art will appreciate that the number and size, as well as the distribution of the fixing members 46 and support members 88 may vary, depending on the purpose of the window and other considerations.

Furthermore, in order to render the window system also ballistic-resistance, the outward facing arm 25 of the frame 24 may be reinforced or covered by a bullet resistant cover, e.g. a steel frame or other resistant material, e.g. non-woven ballistic resistant material such as Kevlar™. Such bullet resistant material may be also applied at an inner side of that profile, so it is noticeable from the outside.

Figure 4A:
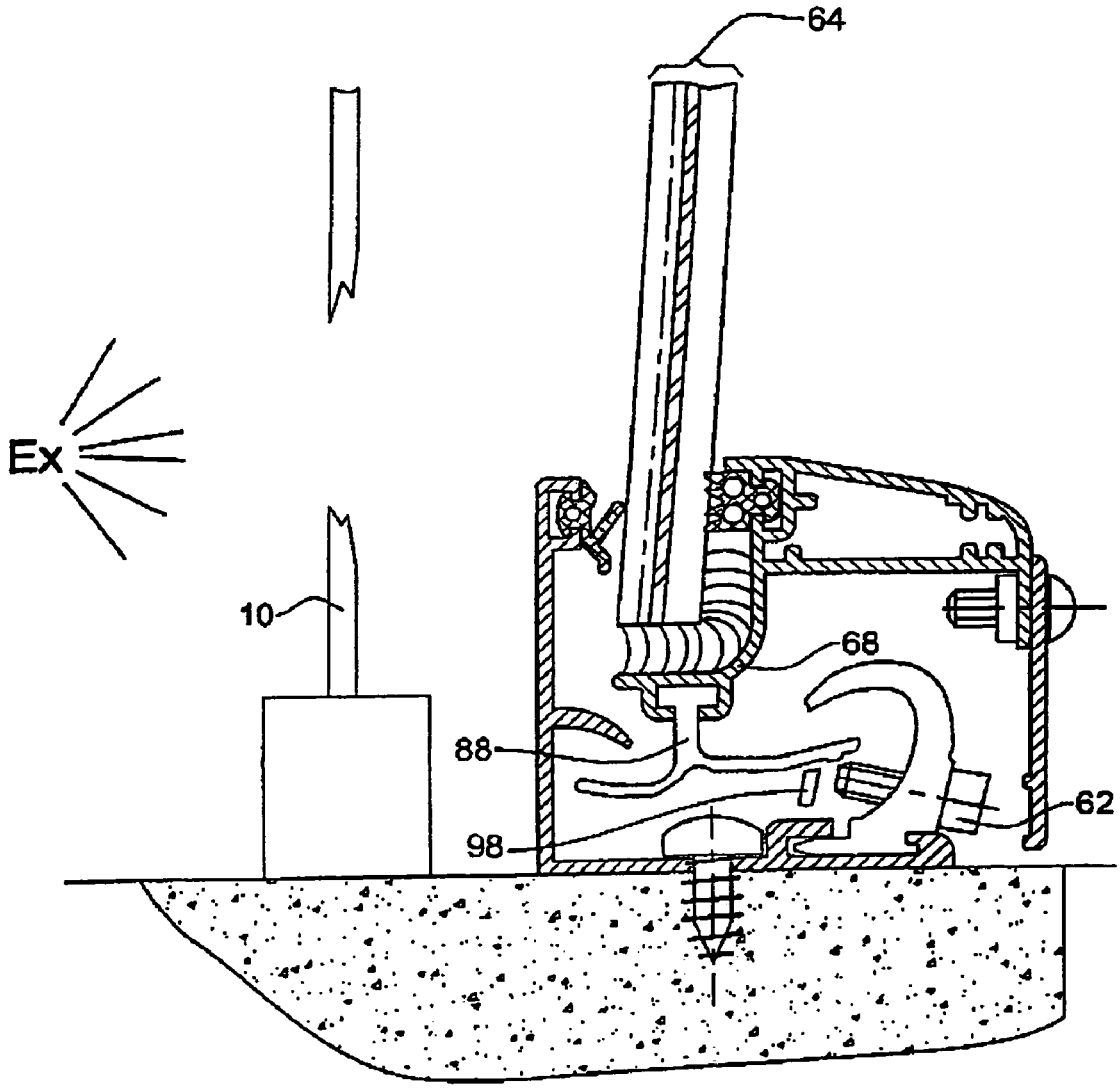
FIGS. 4A–4C represent three progressive stages of deformation of a window system in accordance with the present invention.
Figure 4B:
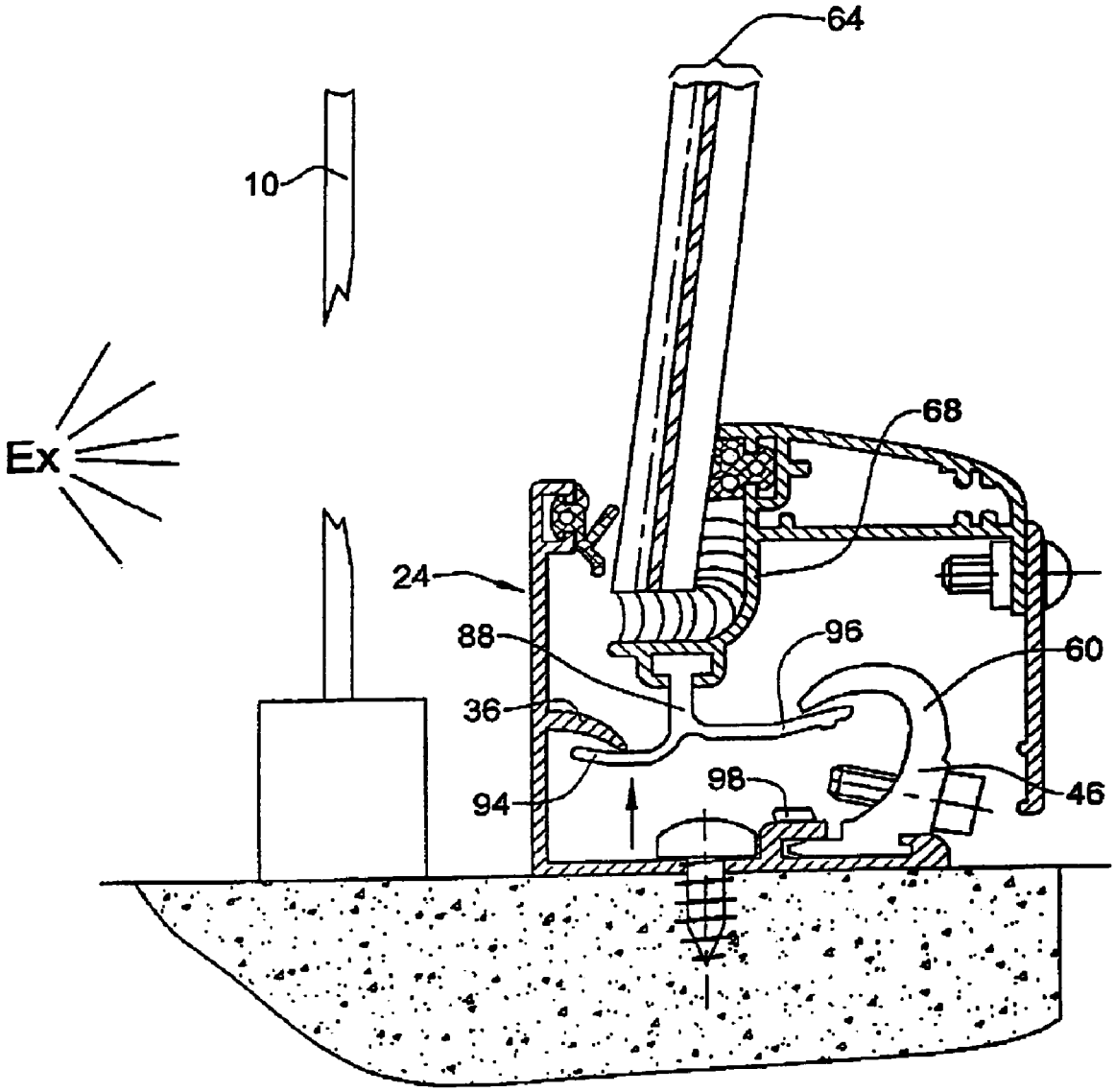
Figure 4C:
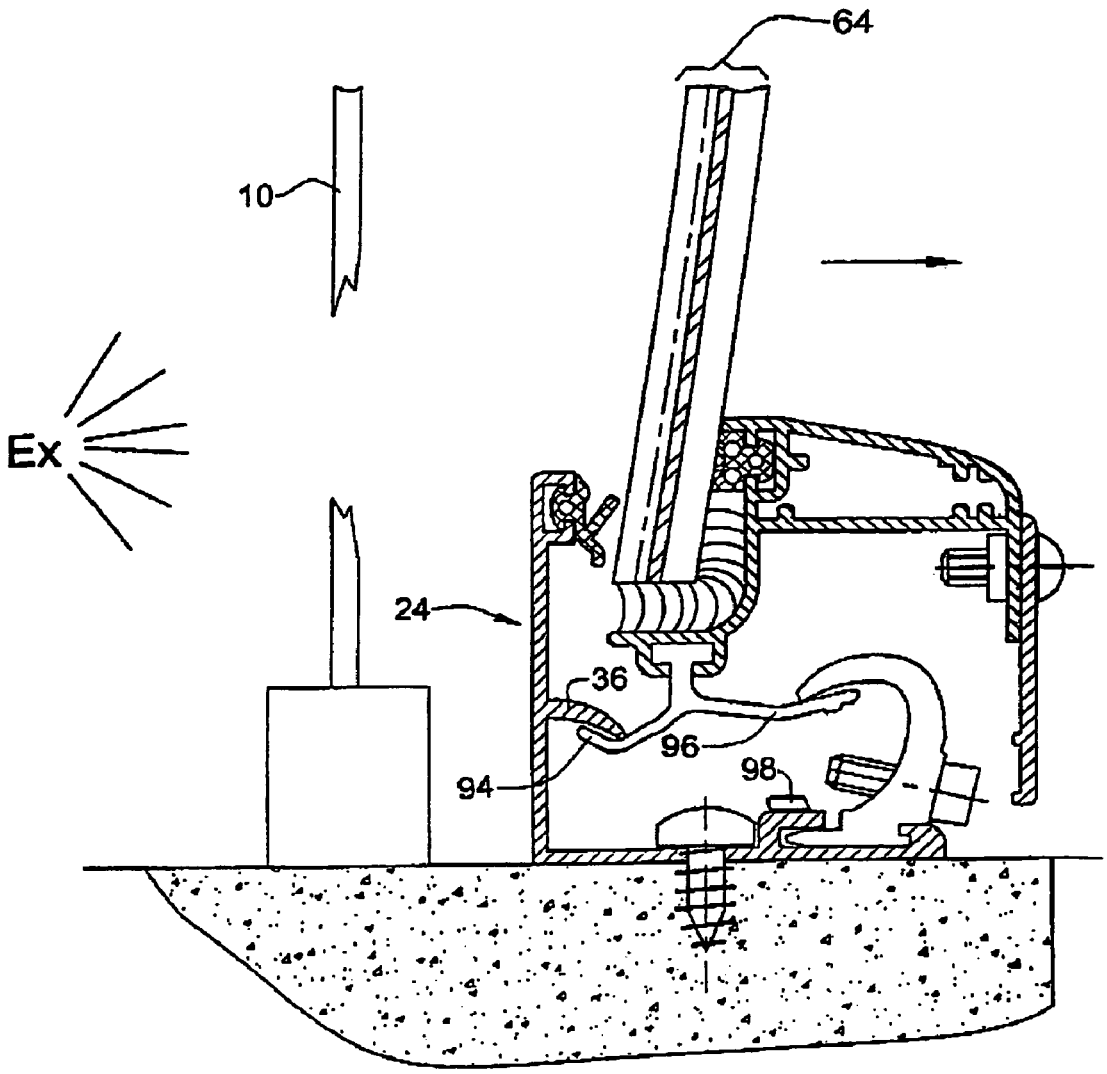

FIGS. 4A–4C illustrate three consecutive stages during a blast caused, e.g. by explosion Ex adjacent the building. At a first instance (FIG. 4A), upon occurrence of the explosion, it is highly expected that the historic window 10 breaks. Simultaneously, the blast encountering the outside face of window pane 64 causes it to slightly deform inwardly, entailing deformation of support frame 68 in two directions, namely in a radial direction, i.e. parallel to the plane of the window pane 64, and in a plane orthogonal to the window pane, whereby the extension 98 of the support member 88 shears, or distorts along with the second arm 96, owing to pressure against the securing bolt 62.

As the window pane 64 continues to deform inwardly (FIG. 4B), the support frame 68 further deforms in the radial and orthogonal direction until one or both of the first arm 94 and second arm 96 of the support member 88 encounter flange 36 of frame 24 and the hooked flange portion 60 of fixing member 46. Further deformation of window pane 64 (FIG. 4C) results in deformation of one or both of the first arm 94 and the second arm 96 or in extreme cases also, of shear thereof. In this manner the blast energy is wasted by converting it into mechanical deformation of the metal frame members.

It is to be appreciated that the support members and/or fixing members may be staggered so as to gradually engage one another, thereby providing increasing force dampening resistance. Also, the first arms 94 and 96 and the corresponding flanges 36 and hooked flanges 60, may be pre designed so as to gradually deform or sheer, depending on the required energy dampening effect. Different parameters may be controlled, e.g. length and thickness of the components, imparting them with reinforcement ribs or, contrary thereto, with sheer grooves, etc.

A person skilled in the art will not have any difficulty to understand that the size and shape of the first and second arms 94 and 96 and the extension 98 of the support member, as well as the size and shape of corresponding flanges 36 and hooked flange portions 60 may be designed to withstand different magnitudes of forces, taking into consideration the blast resistancy of the window pane.

What is claimed is:

1. A reinforced window system for mounting within an opening in a wall, the window system comprising a first frame adapted to be fitted to the opening, the first frame is provided with a plurality of fixing members distributed on an inside perimeter of the first frame; a unitary second frame, which is separate from the first frame and is removably installable therein, the second frame carries a reinforced window pane physically secured within the second frame; the second frame is provided with a plurality of support members, all of which are distributed on an outside perimeter of the second frame to face the fixing members of the first frame and to support the second frame when the support members are in engagement with the fixing members; at least some of the fixing members have a securing means for securing a position of the second frame within the first frame.

2. A window system according to claim 1, wherein at least some of the support members are removably attached to the outside perimeter of the second frame, the support members being configured as bifurcated members having a leg portion, attachable to the second frame and an arm portion, extending towards the fixing members of the first frame and engageable therewith, said arm portion comprises a first arm and a second arm.

3. A window system according to claim 1, wherein at least some of the support members have an arm portion with a first arm and a second arm and some of the fixing members are removably attached to the inside perimeter of the first frame, said first frame and the fixing members being provided with flange portions adapted to engage respectively the second arm and the first arm of the support members.

4. A window system according to claim 3, wherein some of the flange portions of the fixing members are configured as hook-like portions adapted to engage the first arm of the support members.

5. A window system according to claim 3, wherein some of the flange portions of the first frame constitute elongated protrusions formed on the inside perimeter of the first frame and said protrusions are directed towards the second arm of the support members.

6. A window system according to claim 3, wherein the second frame is displaceable in a radial inward direction by forces associated with a shock wave striking the window pane, whereby the first arm and second arm of at least some of the support members respectively engage the corresponding flange portions of the fixing members and of the first frame.

7. A window system according to claim 6, wherein the first arms and second arms of the arm portions of at least some of the support members enable dissipation of the energy associated with the energy associated with the shock wave striking the window pane, said dissipation being caused at a first stage by deformation of the respective arm portions, and at a second stage by shear of at least a part of at least one of the first arms.

8. A window system according to claim 1, wherein the fixing members are adjustable and removable.

9. A window system according to claim 1, wherein the securing means comprises a fixation screw adapted to bear against a corresponding arm portion of the support member.

10. A window system according to claim 1, wherein the support members are fixed at their locations to the second frame.

11. A window system according to claim 1, wherein the window pane is fixed to the second frame by an adhesive material.

12. A window system according to claim 11, wherein the adhesive material is a low-module silicone glue.

13. A window system according to claim 1, wherein the window pane is fixed to the second frame by a mechanical glazing system, fitted with resilient gaskets at both faces of the window frame.

14. A window system according to claim 1, wherein the window pane sealingly bears against the first frame.

15. A window system according to claim 14, wherein a resilient sealing member is fitted between an outside face of the window pane and the first frame.

16. A window system according to claim 1, wherein said system is adapted to be fitted behind an existing window system installed in the wall opening.

17. A window system according to claim 1, further comprising a concealing panel removably secured on the second frame.

18. A window system according to claim 1, wherein a width dimension defines the support members and the adjacent support members are provided with different width dimension.

19. A window system according to claim 1, being a fool-proof system, whereby the fixing members of the first frame and the corresponding support members of the second frame are distributed along respective inside and outside perimeter of the first frame and the second frame such that the fixing members extend opposite corresponding support members only at a correct mounting of the second frame within the first frame.

20. A framework for a removable reinforced window system comprising a first frame adapted to be fitted within an opening in a wall; the first frame comprising a plurality of fixing members distributed on an inside perimeter of the first frame; a unitary second frame, which is separate from the first frame and is removably installable therein, the second frame capable of carrying a reinforced window pane fixedly attachable to the second frame, and the second frame is provided with a plurality of support members, all of which are distributed on an outside perimeter of the second frame to face the fixing members of the first frame and to support the second frame by engagement with the fixing members; at least some of said fixing members of the first frame have a securing means for securing a position of the second frame within the first frame.

21. A framework according to claim 20, which is adapted to be fitted behind an existing window system installed in the opening.

22. A framework according to claim 20, wherein the support members are formed with arm portions extending towards corresponding fixing members of the first frame, said arm portions are formed with a first and second arm.

23. A framework according to claim 22, wherein the first frame and the fixing members are formed with flange portions and at least some of the fixing members are formed with the flange portions configured as hook-like portions adapted to engage corresponding first arms of the support members.

24. A framework according to claim 23, wherein at least some of the frame portions of the first frame constitute elongated protrusions formed on the inner perimeter of the first frame, said protrusions formed on the inner perimeter of the first frame, said protrusions being directed towards corresponding second arms of the support members.

25. A reinforced window system for mounting within an opening in a wall, the window system comprising:

a first frame adapted to be fitted to the opening;

a plurality of fixing members provided on the first frame and distributed on an inside perimeter of the first frame;

a unitary second frame, which is separate from the first frame and is removably installable therein;

a reinforced window pane physically secured within the second frame; and a plurality of support members, all of which are provided on said second frame and distributed on an outside perimeter of the second frame to face the fixing members of the first frame and to support the second frame when the support members are in engagement with the fixing members, wherein at least some of the fixing members have a securing means for securing a position of the second frame within the first frame and at least some of the support members of the second frame absorb energy associated with a shock wave that strikes the window pane.

26. A framework for a removable reinforced window system, the window system having a reinforced window pane, the framework comprising:

a first frame adapted to be fitted within an opening in a wall;

a plurality of fixing members provided on the first frame and distributed on an inside perimeter of the first frame;

a unitary second frame, which is separate from the first frame and is removably installable therein, the second frame capable of having the window pane fixedly attached thereto;

a plurality of support members, all of which are provided on the second frame and distributed on an outside perimeter of the second frame to face the fixing members of the first frame and to support the second frame by engagement with the fixing members, wherein at least some of the fixing members of the first frame have a securing means for securing a position of the second frame within the first frame and at least some of the support members of the second frame absorb energy associated with a shock wave that strikes the window pane.

* * * * *